US011780221B2

(12) United States Patent
Saito et al.

(10) Patent No.: US 11,780,221 B2
(45) Date of Patent: Oct. 10, 2023

(54) LIQUID EJECTION DEVICE

(71) Applicant: SEIKO EPSON CORPORATION, Tokyo (JP)

(72) Inventors: Yuji Saito, Shiojiri (JP); Yasuyoshi Hama, Shimosuwa-machi (JP); Hideki Kojima, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/164,102

(22) Filed: Feb. 1, 2021

(65) Prior Publication Data

US 2021/0237430 A1 Aug. 5, 2021

(30) Foreign Application Priority Data

Jan. 31, 2020 (JP) ..... 2020-014618

(51) Int. Cl.
*B41J 2/045* (2006.01)
*B41J 2/14* (2006.01)
*B41J 11/00* (2006.01)

(52) U.S. Cl.
CPC ..... *B41J 2/04501* (2013.01); *B41J 2/14048* (2013.01); *B41J 11/0021* (2021.01)

(58) Field of Classification Search
CPC ..... B41J 2/14048; B41J 2/04501; B41J 2/14274; B41J 2/04581; B41J 11/0021; B41J 2/125; B41J 2/04508; B41J 2/04561; B41J 2/04591; B41J 2/0459; B41J 11/002; B41J 11/0015; B41J 11/00214; B41J 11/00216
See application file for complete search history.

(56) References Cited

U.S. PATENT DOCUMENTS

2006/0023046 A1* 2/2006 Miura ..... G02B 5/201 347/102
2017/0290934 A1 10/2017 Dobrinsky et al.
2019/0105139 A1 4/2019 Zhou

FOREIGN PATENT DOCUMENTS

JP 2019517836 A 6/2019
JP 2019517838 A 6/2019
WO WO03064162 * 7/2003 ..... B41J 2/09

* cited by examiner

*Primary Examiner* — Kristal Feggins
(74) *Attorney, Agent, or Firm* — CHIP LAW GROUP

(57) ABSTRACT

A liquid ejection device includes: an ejecting unit configured to eject a liquid from a nozzle in a first direction; and a light source unit configured to emit light in a first optical path and a second optical path which are arranged such that the first optical path and the second optical path intersect on an extension line in the first direction from the nozzle. With the liquid ejection device having such a configuration, it becomes easy to eject the liquid at a position having a preferable interval with respect to an object.

10 Claims, 11 Drawing Sheets

LIQUID EJECTION DEVICE

The present application is based on, and claims priority from JP Application Serial Number 2020-014618, filed Jan. 31, 2020, the disclosure of which is hereby incorporated by reference herein in its entirety.

BACKGROUND

1. Technical Field

The present disclosure relates to a liquid ejection device.

2. Related Art

In the related art, various liquid ejection devices that eject a liquid to an object are used. In such a liquid ejection device, it is required to eject the liquid at a position where a preferable interval with respect to the object is obtained. For example, in an inkjet printer, a distance from an ink ejection nozzle to a recording medium is severely adjusted. For example, Japanese Translation of PCT International Application Publication No. JP-T-2019-517836 discloses a visible toothbrush capable of ejecting a liquid to an affected area as an object while illuminating the affected area with illumination.

However, for example, a mechanism for adjusting a distance from the ejection nozzle to the medium in the inkjet printer tends to be complicated. Ina configuration in which the liquid is ejected to the object while simply illuminating the object with illumination, such as the visible toothbrush of JP-T-2019-517836, it is difficult to grasp a preferable interval from an ejecting unit to the object because a proper position with respect to the object is not indicated.

SUMMARY

A liquid ejection device according to the present disclosure includes: an ejecting unit configured to eject a liquid from a nozzle in a first direction; and a light source unit configured to emit light in a first optical path and a second optical path which are arranged such that the first optical path and the second optical path intersect on an extension line in the first direction from the nozzle.

DESCRIPTION OF EXEMPLARY EMBODIMENTS

Figure 1:
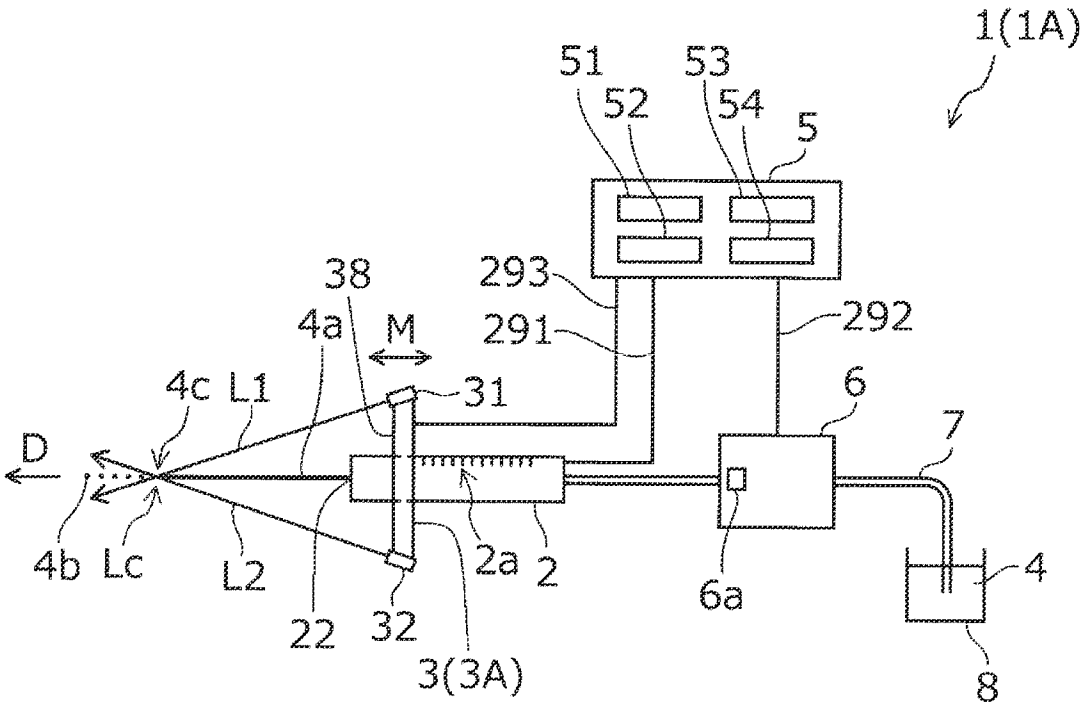
FIG. 1 is a schematic diagram showing a liquid ejection device according to a first embodiment in a state in which an intersection position of a first optical path and a second optical path is a droplet formation position.

First, the present disclosure will be briefly described.

A liquid ejection device according to a first aspect of the present disclosure includes: an ejecting unit configured to eject a liquid from a nozzle in a first direction; and alight source unit configured to emit light in a first optical path and a second optical path which are arranged such that the first optical path and the second optical path intersect on an extension line in the first direction from the nozzle.

According to the present aspect, the first optical path and the second optical path intersect on the extension line in the first direction, which is an ejection direction of the liquid, from the nozzle. Therefore, with a simple configuration in which the first optical path and the second optical path intersect on the extension line from the nozzle, it is possible to easily grasp, based on an intersection position of the first optical path and the second optical path, a position where a preferable interval with respect to an object is obtained, and it is possible to easily dispose the liquid ejection device with a preferable interval with respect to the object.

The liquid ejection device according to a second aspect of the present disclosure is directed to the first aspect, in which the light source unit is configured to adjust an intersection position of the first optical path and the second optical path on the extension line.

According to the present aspect, the light source unit can adjust the intersection position of the first optical path and the second optical path on the extension line. Therefore, when the preferable interval with respect to the object changes according to an ejection state of the liquid, it is possible to easily dispose the liquid ejection device with a preferable interval with respect to the object by adjusting the intersection position.

The liquid ejection device according to a third aspect of the present disclosure is directed to the first aspect or the second aspect, in which the ejecting unit has a configuration in which the liquid is continuously ejected from the nozzle, and the liquid in a continuous state is formed into a droplet at a droplet formation position on the extension line.

When the liquid ejection device is used in which the ejecting unit has a configuration in which the liquid is continuously ejected from the nozzle and the liquid in the continuous state is formed into the droplet at the droplet formation position on the extension line, the liquid ejection device is preferably disposed such that the object is disposed at a position where the liquid is formed into the droplet so as to obtain a preferable interval with respect to the object. According to the present aspect, in the liquid ejection device having such a configuration, the liquid ejection device can be easily disposed at a preferable position.

The liquid ejection device according to a fourth aspect of the present disclosure is directed to the third aspect, in which an intersection position of the first optical path and the second optical path on the extension line is the droplet formation position.

According to the present aspect, in the light source unit, the intersection position of the first optical path and the second optical path on the extension line is the droplet formation position. Therefore, the liquid ejection device can be easily disposed at a preferable position.

The liquid ejection device according to a fifth aspect of the present disclosure is directed to the fourth aspect, in which the liquid ejection device further includes: a processor configured to control an ejection state of the liquid ejected by the ejecting unit and adjust the intersection position by the light source unit, and the processor adjusts the intersection position according to the ejection state.

According to the present aspect, the processor adjusts the intersection position of the first optical path and the second optical path on the extension line according to the ejection state of the liquid ejected by the ejecting unit. Therefore, even when the ejection state of the liquid ejected by the ejecting unit is changed, the intersection position can be adjusted under automatic control of the processor, so that the liquid ejection device can be easily disposed at a preferable position.

The liquid ejection device according to a sixth aspect of the present disclosure is directed to the fifth aspect, in which the liquid ejection device further includes: a pump configured to change a flow rate of the liquid in the nozzle, a flowmeter configured to measure the flow rate, and a memory configured to store data related to the intersection position based on the flow rate, and the processor adjusts the intersection position based on a flow rate measurement result of the flowmeter and the data stored in the memory.

According to the present aspect, the flow rate of the liquid can be easily changed by the pump. In addition, even when the ejection state of the liquid ejected by the ejecting unit is changed by changing the flow rate of the liquid, the intersection position can be adjusted under the automatic control of the processor, so that the liquid ejection device can be easily disposed at a preferable position.

The liquid ejection device according to a seventh aspect of the present disclosure is directed to one of the first to sixth aspects, in which the light in the first optical path and the light in the second optical path is both visible light and has different wavelengths.

If the wavelengths of the light in the first optical path and the light in the second optical path are the same, when the intersection position of the first optical path and the second optical path on the extension line is deviated, it may be difficult to determine whether the interval with respect to the object is deviated to a near side or a far side. However, according to the present aspect, since the light in the first optical path and the light in the second optical path is visible light having different wavelengths, a positional relationship between the light in the first optical path and the light in the second optical path is reversed depending on whether the interval with respect to the object is deviated to the near side or the far side. Therefore, the liquid ejection device can be easily disposed at a preferable position.

Hereinafter, embodiments of the present disclosure will be described with reference to accompanying drawings.

First Embodiment

First, a liquid ejection device 1A according to a first embodiment as a liquid ejection device 1 according to the present disclosure will be described with reference to FIGS. 1 to 9. As will be described in detail later, an ejecting unit 2 of the liquid ejection device 1A according to the present embodiment has a configuration in which a liquid 4 can be continuously ejected from a nozzle 22 and a liquid 4*a* in a continuous state can be formed into a droplet 4*b* at a droplet formation position 4*c* on an extension line in an ejection direction D of the liquid 4. However, the present disclosure is not limited to the liquid ejection device including such an ejecting unit. For example, a configuration may be adopted in which the ejecting unit such as that used in a general inkjet printer is provided.

Figure 2:
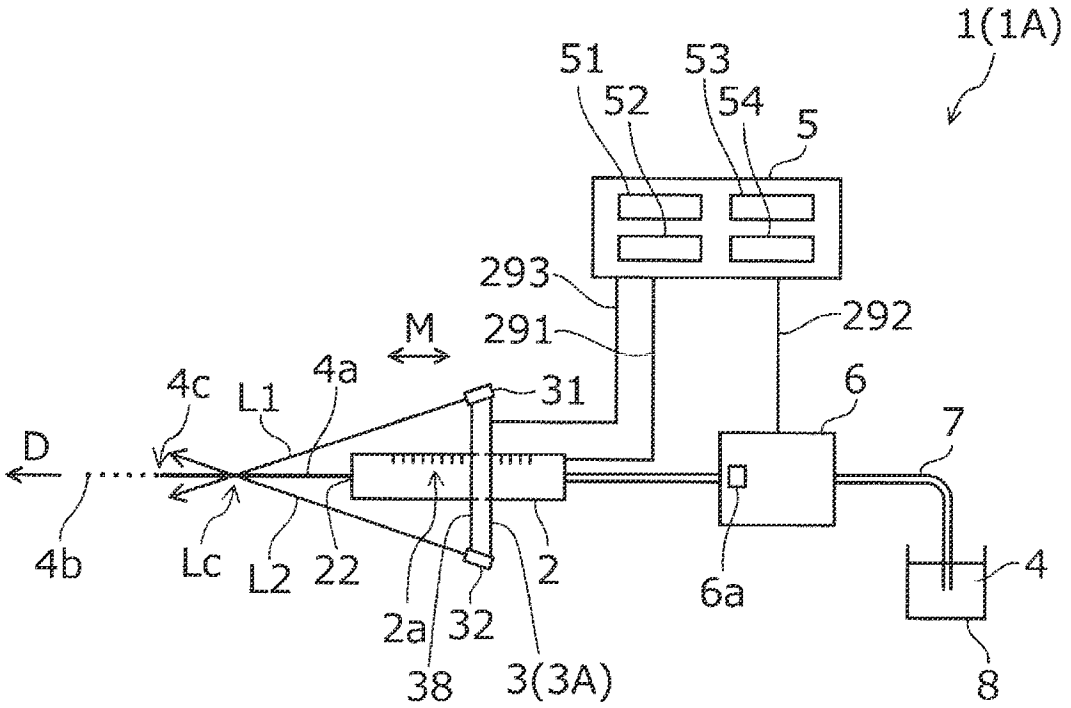
FIG. 2 is a schematic diagram showing the liquid ejection device according to the first embodiment in a state in which the intersection position of the first optical path and the second optical path is not the droplet formation position.
Figure 4:
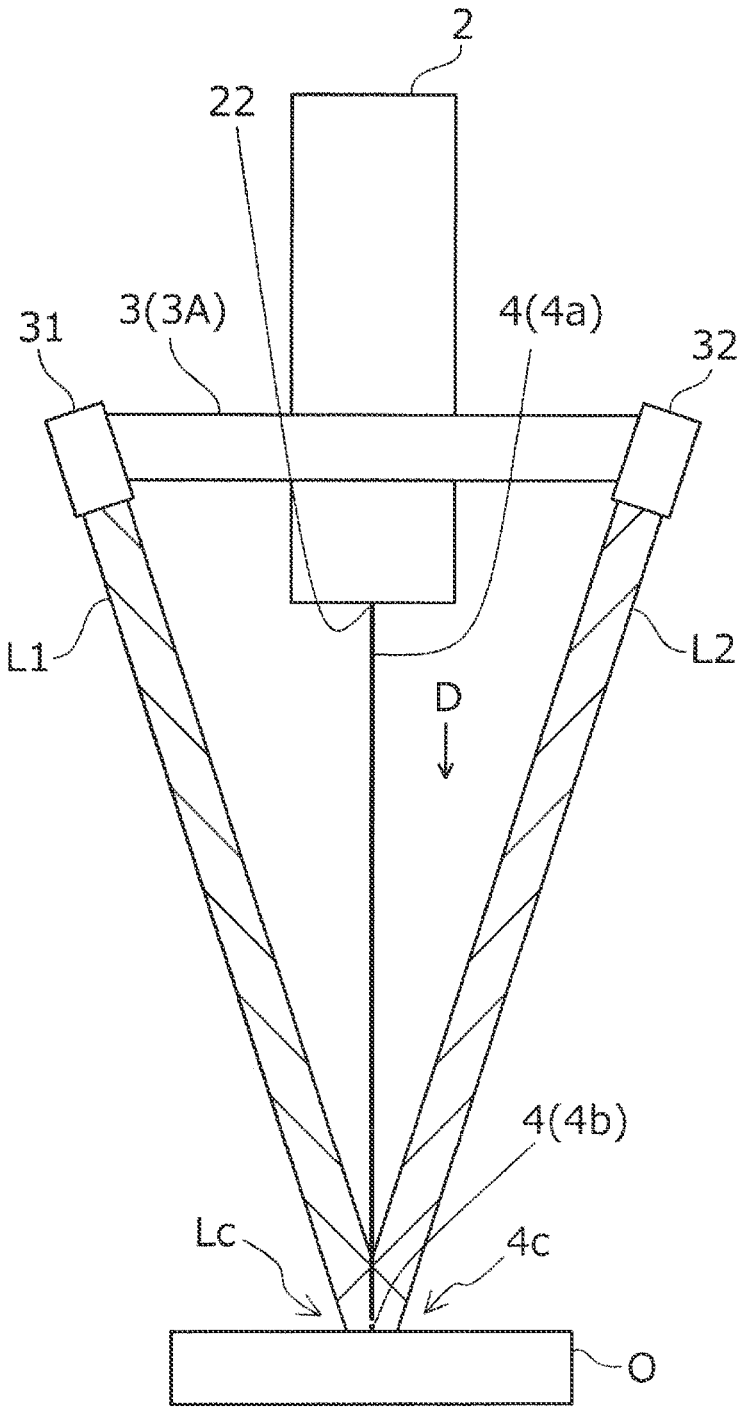
FIG. 4 is a diagram showing a state in which an interval from the ejecting unit to an object matches a distance from the ejecting unit to the intersection position of the first optical path and the second optical path in the liquid ejection device according to the first embodiment.

The liquid ejection device 1A shown in FIGS. 1 and 2 includes the ejecting unit 2, a light source unit 3, a liquid container 8 for storing the liquid 4, a liquid supply pipe 7 coupling the ejecting unit 2 and the liquid container 8, a pump 6, and a control unit 5. Such a liquid ejection device 1A performs various kinds of work by disposing the ejecting unit 2 with a desired interval with respect to an object O using the light source unit 3, ejecting the liquid 4 from the ejecting unit 2, and the liquid 4 colliding with the object O as shown in FIG. 4 or the like. Examples of the various kinds of work include cleaning, deburring, peeling, trimming, excising, incising, and crushing. Hereinafter, each unit of the liquid ejection device 1A will be described in detail.

Ejecting Unit

Figure 3:
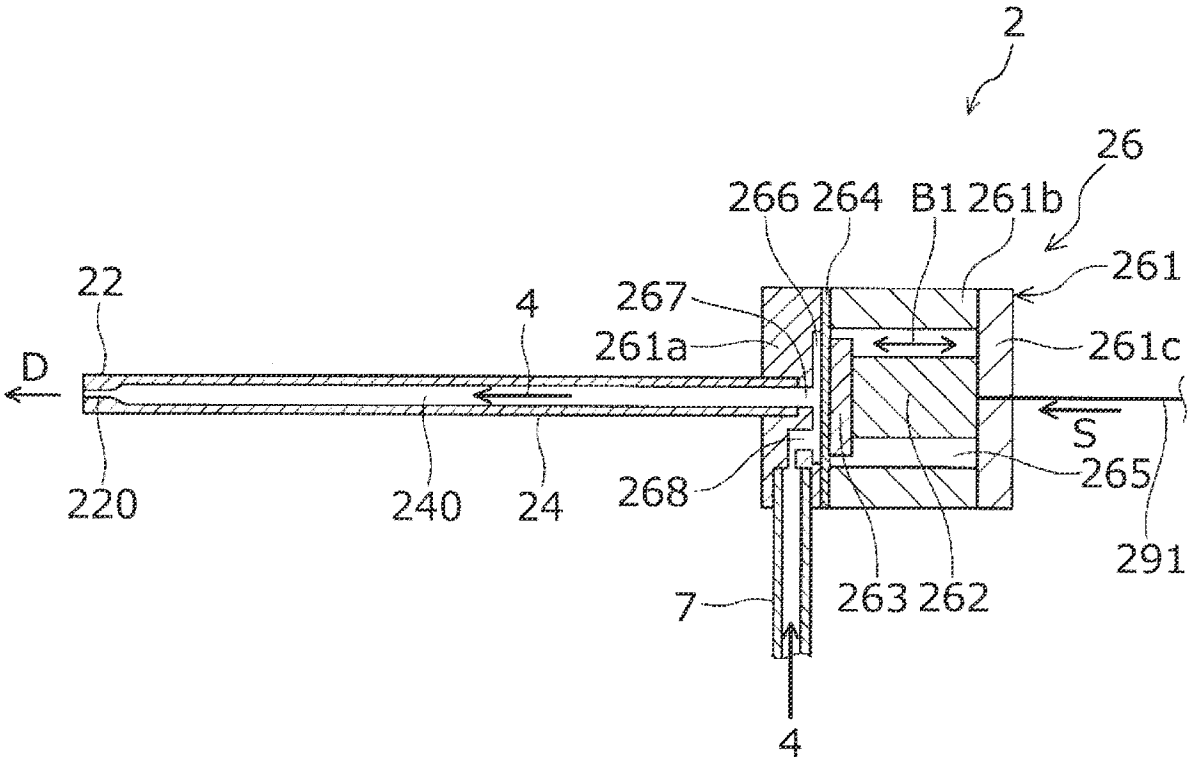
FIG. 3 is a cross-sectional view showing an ejecting unit of the liquid ejection device according to the first embodiment.

As shown in FIG. 3, the ejecting unit 2 includes the nozzle 22, a liquid transporting pipe 24, and a pulsation generation unit 26. Among these components, the nozzle 22 ejects the liquid 4 toward the object O. The liquid transporting pipe 24 is a flow path that couples the nozzle 22 and the pulsation generation unit 26. The liquid transporting pipe 24 transports the liquid 4 from the pulsation generation unit 26 to the nozzle 22. Further, the pulsation generation unit 26 applies a flow rate pulsation to the liquid 4 supplied from the liquid container 8 through the liquid supply pipe 7. By applying a pulsation to the liquid 4 thus, a flow velocity of the liquid 4 ejected from the nozzle 22 periodically fluctuates. Accordingly, a distance until the liquid 4*a* in a continuous state ejected from the nozzle 22 is changed into the droplet 4*b*, that is, a droplet formation distance can be shortened. That is, the ejecting unit 2 according to the present embodiment is configured to change a distance of the droplet formation position 4*c* to the nozzle 22. The liquid 4*b* formed into the droplet eventually becomes a diffusion jet that deviates significantly from the extension line in the ejection direction D. In this case, since the number of the droplets 4*b* on the extension line in the ejection direction D is reduced, a desired effect cannot be obtained. That is, the droplet formation position 4*c* indicating a position where the continuous liquid 4*a* is changed into the droplet 4*b* to a position where the diffusion jet is formed is a position at which an energy applied to the outside by the liquid 4 ejected from the nozzle 22 is the largest. A boundary between the droplet formation position 4*c* and a diffusion jet region can be determined by the fact that an energy application to the object O changes significantly when a position of the object O on the extension line in the ejection direction D is changed due to flight of the droplet 4*b* significantly deviating from the extension line in the ejection direction D, for example. Even if the energy applied to the object O is not measured, the boundary can also be determined by observing the flight of the droplet 4*b*, such as setting a threshold value showing how much the flight of the droplet 4*b* deviates from the extension line in the ejection direction D, and recombining the droplet 4*b*.

Hereinafter, each component of the ejecting unit 2 will be described in detail. The nozzle 22 is attached to a tip end portion of the liquid transporting pipe 24. The nozzle 22 is internally provided with a nozzle flow path 220 through which the liquid 4 passes. An inner diameter of a tip end portion of the nozzle flow path 220 is smaller than an inner diameter of a base end portion of the nozzle flow path 220. The liquid 4 transported towards the nozzle 22 in the liquid transporting pipe 24 is formed into a trickle through the nozzle flow path 220 and is ejected. The nozzle 22 may be a member provided separately from the liquid transporting pipe 24 or may be integral with the liquid transporting pipe 24.

The liquid transporting pipe 24 is a pipe that couples the nozzle 22 and the pulsation generation unit 26, and a liquid flow path 240 for transporting the liquid 4 is provided inside the liquid transporting pipe 24. The nozzle flow path 220 communicates with the liquid supply pipe 7 via the liquid flow path 240. The liquid supply pipe 7 may be a straight pipe, or may be a curved pipe in which a part of or the entire pipe is curved.

The nozzle 22 and the liquid transporting pipe 24 may have rigidity such that the nozzle 22 and the liquid transporting pipe 24 do not deform when the liquid 4 is ejected. Examples of a constituent material of the nozzle 22 include such as a metal material, a ceramic material, and a resin material. Examples of a constituent material of the liquid transporting pipe 24 include such as a metal material and a resin material, and the metal material is particularly preferably used.

The inner diameter of the nozzle flow path 220 is appropriately selected according to a work content, a material of the object O, and the like, and is preferably, for example, 0.01 mm or more and 1.00 mm or less, and more preferably 0.02 mm or more and 0.30 mm or less.

The pulsation generation unit 26 includes a housing 261, a piezoelectric element 262 and a reinforcing plate 263 that are provided in the housing 261, and a diaphragm 264. The housing 261 has a box shape, and includes a first case 261*a*, a second case 261*b*, and a third case 261*c*. Each of the first case 261*a* and the second case 261*b* has a cylindrical shape including a through hole penetrating from a base end to a tip end. Further, the diaphragm 264 is interposed between an opening on a base end side of the first case 261*a* and an opening on a tip end side of the second case 261*b*. The diaphragm 264 is, for example, a film member having elasticity or flexibility.

The third case 261*c* has a plate shape. The third case 261*c* is fixed to an opening on a base end side of the second case 261*b*. A space formed by the second case 261*b*, the third case 261*c*, and the diaphragm 264 is an accommodation chamber 265. The piezoelectric element 262 and the reinforcing plate 263 are accommodated in the accommodation chamber 265. A base end of the piezoelectric element 262 is coupled to the third case 261*c*, and a tip end of the piezoelectric element 262 is coupled to the diaphragm 264 via the reinforcing plate 263.

The through hole in the first case 261*a* penetrates from the base end to the tip end. Such a through hole includes a base end-side region having a relatively large inner diameter and a tip end-side region having a relatively small inner diameter. In the regions, the liquid transporting pipe 24 is inserted into the region having the small inner diameter from an opening on the tip end side. In the region having the large inner diameter, the diaphragm 264 is covered from the base end side. A space formed by the region having the large inner diameter and the diaphragm 264 is a liquid chamber 266.

Further, a space between the liquid chamber 266 and the liquid transporting pipe 24 is an outlet flow path 267. On the other hand, an inlet flow path 268 different from the outlet flow path 267 communicates with the liquid chamber 266. One end of the inlet flow path 268 communicates with the liquid chamber 266, and the other end is inserted with the liquid supply pipe 7. Accordingly, an internal flow path of the liquid supply pipe 7 communicates with the inlet flow path 268, the liquid chamber 266, the outlet flow path 267, the liquid flow path 240, and the nozzle flow path 220. As a result, the liquid 4 supplied to the inlet flow path 268 via the liquid supply pipe 7 is ejected sequentially through the liquid chamber 266, the outlet flow path 267, the liquid flow path 240, and the nozzle flow path 220.

A wiring 291 is drawn out from the piezoelectric element 262 via the housing 261. The piezoelectric element 262 is electrically coupled to the control unit 5 via the wiring 291. The piezoelectric element 262 is driven by a drive signal S supplied from the control unit 5 and vibrates so as to repeatedly expand and contract along an X-axis, as indicated by an arrow B1 in FIG. 3, based on a reverse piezoelectric effect. When the piezoelectric element 262 expands, the diaphragm. 264 is pushed toward a first case 261*a* side. Therefore, a volume of the liquid chamber 266 reduces, and the liquid 4 in the liquid chamber 266 is accelerated in the outlet flow path 267. On the other hand, when the piezoelectric element 262 contracts, the diaphragm 264 is drawn toward a third case 261*c* side. Therefore, the volume of the liquid chamber 266 expands, and the liquid 4 in the inlet flow path 268 is decelerated or flows backward.

The piezoelectric element 262 may be an element that performs expanding and contracting vibration, or may be an element that performs bending vibration. The piezoelectric element 262 includes, for example, a piezoelectric body and an electrode provided on the piezoelectric body. Examples of a constituent material of the piezoelectric body include piezoelectric ceramics such as lead zirconate titanate (PZT), barium titanate, lead titanate, potassium niobate, lithium niobate, lithium tantalate, sodium tungstate, zinc oxide, barium strontium titanate (BST), strontium bismuth tantalate (SBT), lead metaniobate, and lead scandium niobate.

The piezoelectric element 262 can be replaced with any element or mechanical element that can displace the diaphragm 264. Examples of such an element or a mechanical element include a magnetostrictive element, an electromagnetic actuator, and a combination of a motor and a cam. The housing 261 may have rigidity such that the housing 261 does not deform when a pressure in the liquid chamber 266 is increased or decreased.

The pulsation generation unit 26 shown in FIG. 3 is provided at a base end portion of the liquid transporting pipe 24, but a position of the pulsation generation unit 26 is not particularly limited. For example, the pulsation generation unit 26 may be provided in the middle of the liquid transporting pipe 24.

Light Source Unit

The liquid ejection device 1A according to the present embodiment includes, as the light source unit 3, a light source unit 3A including a first light irradiation unit 31 and a second light irradiation unit 32. The light source unit 3A has a configuration in which both the first light irradiation unit 31 and the second light irradiation unit 32 are fixed to an arm unit 38 at a predetermined angle, and are movable in a movement direction M that is a direction along the ejection direction D of the liquid 4 with respect to the ejecting unit 2, as can be seen from the comparison between FIGS. 1 and 2.

As shown in FIGS. 1 and 2, the light source unit 3A is provided with the first light irradiation unit 31 and the second light irradiation unit 32 such that a first optical path L1 of light emitted from the first light irradiation unit 31 and a second optical path L2 of light emitted from the second light irradiation unit 32 intersect each other on the extension line in the ejection direction D from the nozzle 22. Since the movement direction M is a direction along the ejection direction D, even when the light source unit 3A is moved in the movement direction M with respect to the ejecting unit 2, the first optical path L1 and the second optical path L2 always intersect on the extension line in the ejection direction D from the nozzle 22.

By moving the light source unit 3A with respect to the ejecting unit 2 in the movement direction M to adjust a position of the light source unit 3A, as shown in FIG. 1, an intersection position Lc of the first optical path L1 and the second optical path L2 can be adjusted so as to overlap the droplet formation position 4*c*. The light source unit 3A according to the present embodiment is configured to be automatically moveable with respect to the ejecting unit 2 under the control of the control unit 5, but a user can manually move the light source unit 3A with respect to the ejecting unit 2. As shown in FIGS. 1 and 2, a scale 2*a* is formed on the ejecting unit 2 according to the present embodiment, and the user can align the light source unit 3A with respect to the ejecting unit 2 with reference to the scale 2*a*.

Liquid Container

The liquid container 8 stores the liquid 4. The liquid 4 stored in the liquid container 8 is supplied to the ejecting unit 2 via the liquid supply pipe 7. As the liquid 4, for example, water is preferably used, but an organic solvent may be used. Any solute may be dissolved in the water or the organic solvent, and any dispersoid may be dispersed in the water or the organic solvent. The liquid container 8 may be a sealed container or an open container.

Pump

The pump 6 is provided in the middle or an end portion of the liquid supply pipe 7. The liquid 4 stored in the liquid container 8 is suctioned by the pump 6 and supplied to the ejecting unit 2 at a predetermined pressure. The control unit 5 is electrically coupled to the pump 6 via a wiring 292. The pump 6 has a function of changing, based on a drive signal output from the control unit 5, a flow rate of the liquid 4 to be supplied. A flow rate in the pump 6 is preferably 1 mL/min or more and 100 mL/min or less, more preferably 2 mL/min or more and 50 mL/min or less, for example. The pump 6 is provided with a measurement unit 6*a* such as a flowmeter that measures an actual flow rate.

Control Unit

The control unit 5 is electrically coupled to the ejecting unit 2 via the wiring 291. The control unit 5 is electrically coupled to the pump 6 via the wiring 292. Further, the control unit 5 is electrically coupled to the light source unit 3 via a wiring 293. The control unit 5 shown in FIGS. 1 and 2 includes a piezoelectric element control unit 51, a pump control unit 52, a light source unit drive control unit 53, and a storage unit 54.

The piezoelectric element control unit 51 outputs the drive signal S to the piezoelectric element 262. Driving of the piezoelectric element 262 is controlled by the drive signal S. Accordingly, the diaphragm 264 can be displaced, for example, at a predetermined frequency and by a predetermined displacement amount. The pump control unit 52 outputs a drive signal to the pump 6. Driving of the pump 6 is controlled by the drive signal. Accordingly, the liquid 4 can be supplied to the ejecting unit 2, for example, at a predetermined pressure and for a predetermined drive time. The light source unit drive control unit 53 controls the movement of the first light irradiation unit 31 and the second light irradiation unit 32 in the movement direction M. The control unit 5 can control the driving of the pump 6 and the driving of the piezoelectric element 262 in cooperation with each other.

The control unit 5 reads optimum distance data stored in the storage unit 54 based on a set flow rate that is set by the user using a control panel (not shown) or the like or a measurement flow rate as a measurement result of the measurement unit 6*a* provided in the pump 6. The distance data is data of the distance from the droplet formation position 4*c* to the nozzle 22, and corresponds to data of an optimum distance from the nozzle 22 to the object O. A table of the optimum distance data corresponding to the set flow rate and the measurement flow rate is stored in the storage unit 54, and the light source unit drive control unit 53 moves the light source unit 3 to a desired position with respect to the ejecting unit 2 based on the table. Specifically, for example, a position of the light source unit 3 with respect to the ejecting unit 2 is changed from a state shown in FIG. 2 to a state shown in FIG. 1. In the present embodiment, a table associating the set flow rate and the measurement flow rate with the distance data is stored in the storage unit 54, but a relational expression associating the set flow rate and the measurement flow rate with the distance data may be stored instead of such a table.

Such a function of the control unit 5 is realized by hardware such as a processor, a memory, and an external interface. Examples of the arithmetic unit include such as a central processing unit (CPU), a digital signal processor (DSP), and an application specific integrated circuit (ASIC). Examples of the memory include such as a read only memory (ROM), a flash ROM, a random access memory (RAM), and a hard disk.

Position of Liquid Ejection Device with Respect to Object

Next, how to align a position of the liquid ejection device 1A with respect to the object O will be described using the liquid ejection device 1A according to the present embodiment.

First, after the position of the light source unit 3 with respect to the ejecting unit 2 is adjusted to a desired position under the control of the control unit 5, the user sets the liquid ejection device 1A at a temporary position with respect to the object O. Here, the desired position is a position where the intersection position Lc of the first optical path L1 and the second optical path L2 is exactly at the droplet formation position 4*c*, as shown in FIG. 1. Then, the first light irradiation unit 31 and the second light irradiation unit 32 irradiate the object O with light.

Figure 5:
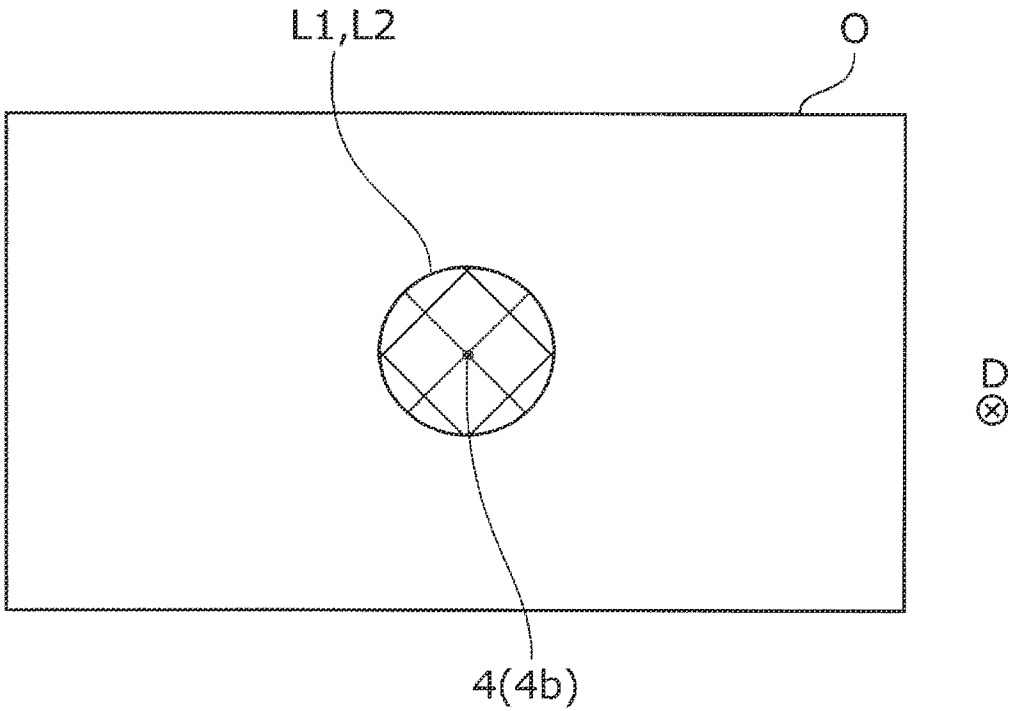
FIG. 5 is a schematic diagram showing positions of the first optical path and the second optical path on the object in the state of FIG. 4.

FIGS. 4 and 5 show a case where the intersection position Lc of the first optical path L1 and the second optical path L2 is exactly at a work target portion of the object O. As described above, the intersection position Lc of the first optical path L1 and the second optical path L2 is adjusted to be exactly at the droplet formation position 4*c*, so that in the state shown in FIGS. 4 and 5, the work target portion of the object O is positioned at the droplet formation position 4*c* where the highest work efficiency is obtained. Therefore, when the temporary set position of the liquid ejection device 1A is in the states shown in FIGS. 4 and 5, the user can perform highly efficient work by performing the work as it is.

Figure 6:
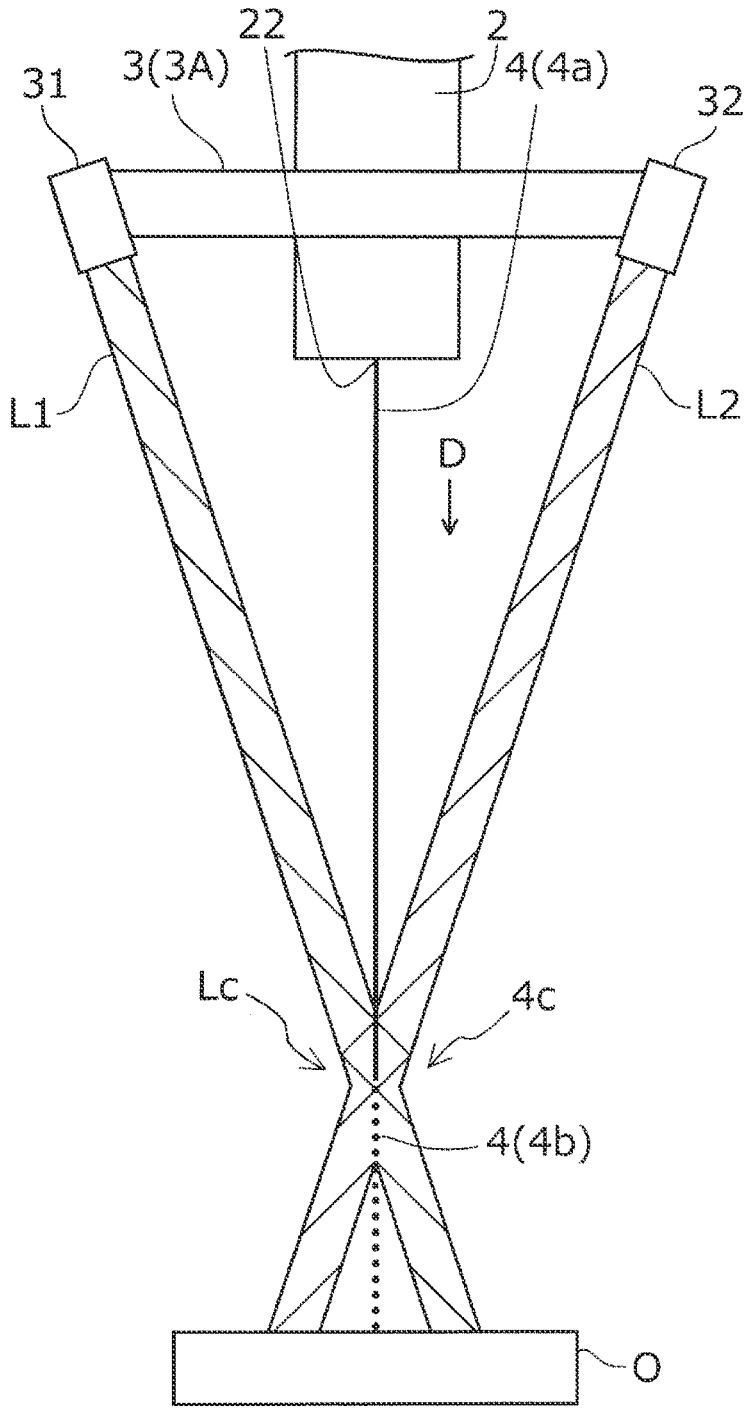
FIG. 6 is a diagram showing a state in which the interval from the ejecting unit to the object is larger than the distance from the ejecting unit to the intersection position of the first optical path and the second optical path in the liquid ejection device according to the first embodiment.
Figure 7:
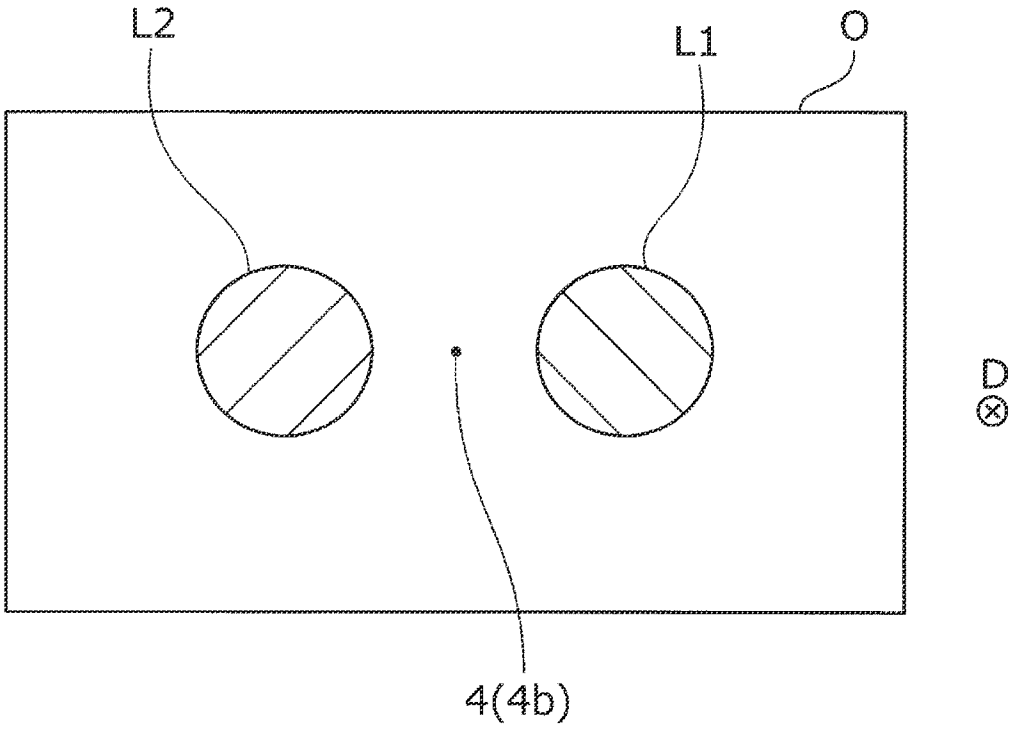
FIG. 7 is a schematic diagram showing the positions of the first optical path and the second optical path on the object in the state of FIG. 6.

FIGS. 6 and 7 show a case where the intersection position Lc of the first optical path L1 and the second optical path L2 is on a front side of the work target portion of the object O. As described above, the intersection position Lc of the first optical path L1 and the second optical path L2 is adjusted to be exactly at the droplet formation position 4*c*, so that in the state shown in FIGS. 6 and 7, the work target portion of the object O is positioned on a far side with respect to the droplet formation position 4*c* where the highest work efficiency is obtained. Therefore, when the temporary set position of the liquid ejection device 1A is in the state shown in FIGS. 6 and 7, the user can perform highly efficient work by bringing the liquid ejection device 1A closer to the object O and by changing the set position of the liquid ejection device 1A so as to be in the state shown in FIGS. 4 and 5.

Figure 8:
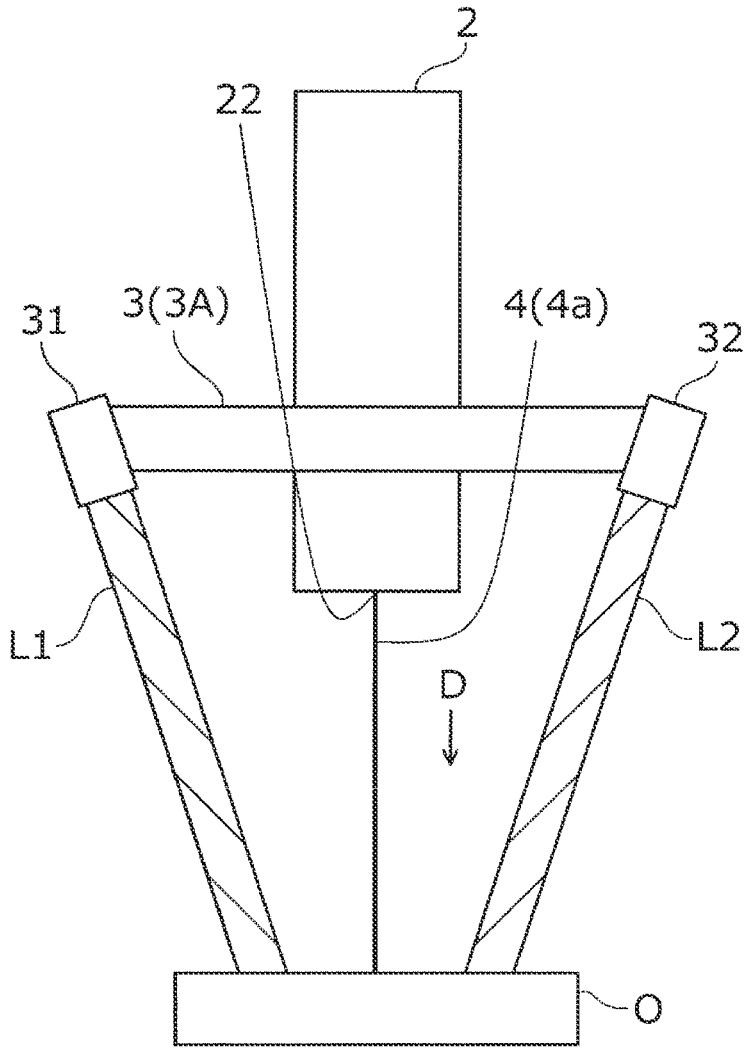
FIG. 8 is a diagram showing a state in which the interval from the ejecting unit to the object is smaller than the distance from the ejecting unit to the intersection position of the first optical path and the second optical path in the liquid ejection device according to the first embodiment.
Figure 9:
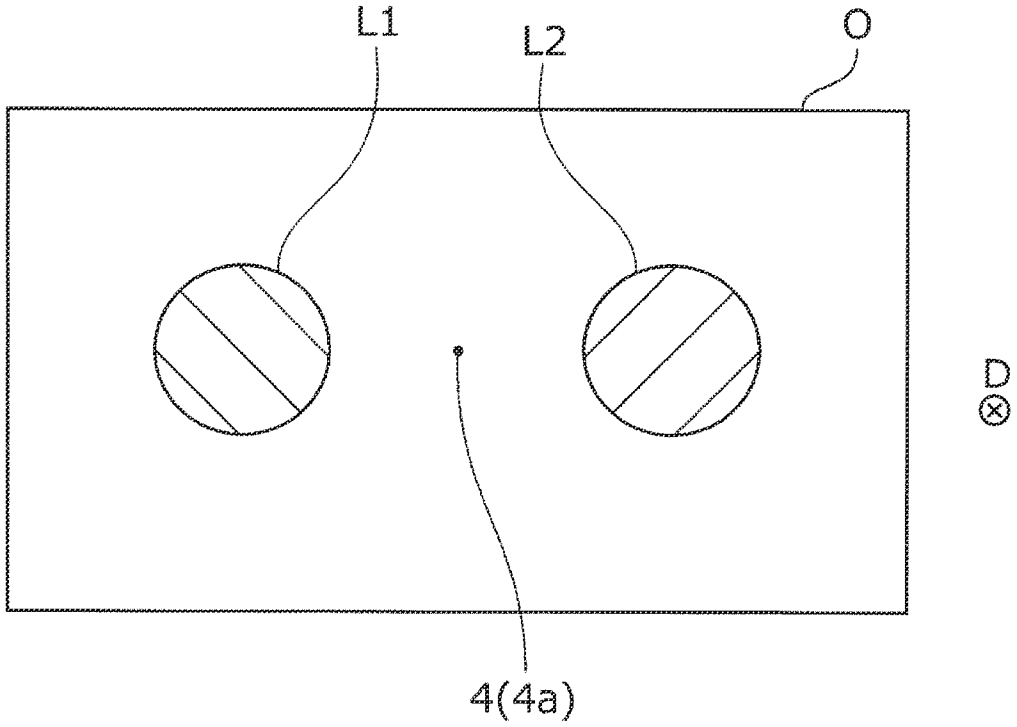
FIG. 9 is a schematic diagram showing the positions of the first optical path and the second optical path on the object in the state of FIG. 8.

FIGS. 8 and 9 show a case where the intersection position Lc of the first optical path L1 and the second optical path L2 is on a back side of the work target portion of the object O. As described above, the intersection position Lc of the first optical path L1 and the second optical path L2 is adjusted to be exactly at the droplet formation position 4*c*, so that in the state shown in FIGS. 8 and 9, the work target portion of the object O is positioned on a near side with respect to the droplet formation position 4*c* where the highest work efficiency is obtained. Therefore, when the temporary set position of the liquid ejection device 1A is in the state shown in FIGS. 8 and 9, the user can perform highly efficient work by bringing the liquid ejection device 1A far from the object O and by changing the set position of the liquid ejection device 1A so as to be in the state shown in FIGS. 4 and 5.

As described above, the liquid ejection device 1A of the present embodiment includes the ejecting unit 2 that ejects the liquid 4 from the nozzle 22 in the ejection direction D serving as the first direction; and the light source unit 3 that emits light in the first optical path L1 and the second optical path L2 which are arranged such that the first optical path L1 and the second optical path L2 intersect on the extension line in the ejection direction D from the nozzle 22. The liquid ejection device 1A according to the present embodiment has such a configuration, so that with a simple configuration in which the first optical path L1 and the second optical path L2 intersect on the extension line from the nozzle 22, it is possible to easily grasp, based on the intersection position Lc of the first optical path L1 and the second optical path L2, a position where a preferable interval with respect to the object O is obtained, and it is possible to easily dispose the liquid ejection device 1A with a preferable interval with respect to the object O.

As described above, the light source unit 3A according to the present embodiment can adjust the intersection position Lc of the first optical path L1 and the second optical path L2. Therefore, in the liquid ejection device 1A according to the present embodiment, when the preferable interval with respect to the object O changes according to an ejection state of the liquid 4, it is possible to easily dispose the liquid ejection device 1A with a preferable interval with respect to the object O by adjusting the intersection position Lc.

As described above, the ejecting unit 2 according to the present embodiment has a configuration in which the liquid 4 is continuously ejected from the nozzle 22 and the liquid 4*a* in a continuous state is formed into the droplet 4*b* at the droplet formation position 4*c* on the extension line in the ejection direction D from the nozzle 22. When the liquid ejection device is used in which the ejecting unit 2 has a configuration in which the liquid 4 is continuously ejected from the nozzle 22 and the liquid 4*a* in the continuous state is formed into the droplet at the droplet formation position 4*c* on the extension line in the ejection direction D from the nozzle 22, it is preferable to dispose the liquid ejection device, such that the object O is disposed at a position where the liquid 4 is formed into the droplet, so as to have a preferable interval with respect to the object O. It is possible to easily dispose the liquid ejection device 1A according to the present embodiment at a preferable position with respect to the object O.

As described above, in the light source unit 3A according to the present embodiment, the intersection position Lc of the first optical path L1 and the second optical path L2 is automatically adjusted to the droplet formation position 4*c*, so that when the liquid 4 is ejected to the object O, the intersection position Lc is in the state of being in the droplet formation position 4*c*. Therefore, it is possible to easily dispose the liquid ejection device 1A according to the present embodiment at a preferable position with respect to the object O.

The liquid ejection device 1A according to the present embodiment includes the light source unit 3A capable of adjusting the intersection position Lc because an ejection flow rate of the liquid from the ejecting unit 2 can be changed and the distance from the nozzle 22 to the droplet formation position 4*c* can be changed. However, if the ejection flow rate of the liquid from the ejecting unit 2 is constant and the distance from the nozzle 22 to the droplet formation position 4*c* is constant, it is not necessary to adjust the intersection position Lc by aligning the position of the intersection position Lc with a position of the droplet formation position 4*c* in advance. Therefore, the liquid ejection device 1 having a configuration in which the distance from the nozzle 22 to the droplet formation position 4*c* is constant may include the light source unit 3 that cannot adjust the intersection position Lc.

As described above, the liquid ejection device 1A according to the present embodiment includes the control unit 5 that controls the ejection state of the liquid 4 ejected by the ejecting unit 2 and adjust the intersection position Lc of the first optical path L1 and the second optical path L2 by the light source unit 3, and the control unit 5 adjusts the intersection position Lc according to the ejection state of the liquid 4 ejected by the ejecting unit 2. Therefore, in the liquid ejection device 1A according to the present embodiment, when the ejection state of the liquid 4 ejected by the ejecting unit 2 is changed, for example, from a small flow rate to a large flow rate, the intersection position Lc can be adjusted under automatic control of the control unit 5, so that it is possible to easily dispose the liquid ejection device 1A at a preferable position with respect to the object O.

As described above, the liquid ejection device 1A according to the present embodiment includes the pump 6 that changes the flow rate of the liquid 4 in the nozzle 22. The pump 6 is provided with the measurement unit 6*a* that measures the flow rate of the liquid 4. Further, a table as data related to the intersection position Lc based on the measurement flow rate measured by the measurement unit 6*a* is stored in the storage unit 54. The control unit 5 can adjust the intersection position Lc based on the table. Thus, the liquid ejection device 1A according to the present embodiment can easily change the flow rate of the liquid 4 by including the pump 6. Further, in the liquid ejection device 1A according to the present embodiment, even when the ejection state of the liquid 4 ejected by the ejecting unit 2 is changed by changing the flow rate of the liquid 4, the intersection position Lc can be adjusted under the automatic control of the control unit 5, so that it is possible to easily dispose the liquid ejection device 1A at a preferable position with respect to the object O.

Here, in the liquid ejection device 1A according to the present embodiment, the light in the first optical path L1 is green visible light, and the light in the second optical path L2 is red visible light. Then, a color of the light at the intersection position Lc is yellow when the light in the first optical path L1 and the light in the second optical path L2 are combined. Thus, it is preferable that the light in the first optical path L1 and the light in the second optical path L2 is both visible light and is light having different wavelengths. If the wavelengths of the light in the first optical path L1 and the light in the second optical path L2 are the same, when the intersection position Lc is deviated, it may be difficult to determine whether the interval with respect to the object O is deviated to the near side or the far side. However, if the light in the first optical path L1 and the light in the second optical path L2 is visible light having different wavelengths, as is clear from the comparison between FIGS. 7 and 9, a positional relationship between the light in the first optical path L1 and the light in the second optical path L2 is reversed depending on whether the interval of the liquid ejection device with respect to the object O is deviated to the near side or the far side. Therefore, when the light in the first optical path L1 and the light in the second optical path L2 is both visible light and has different wavelengths, the liquid ejection device can be easily disposed at a preferable position.

Second Embodiment

Figure 10:
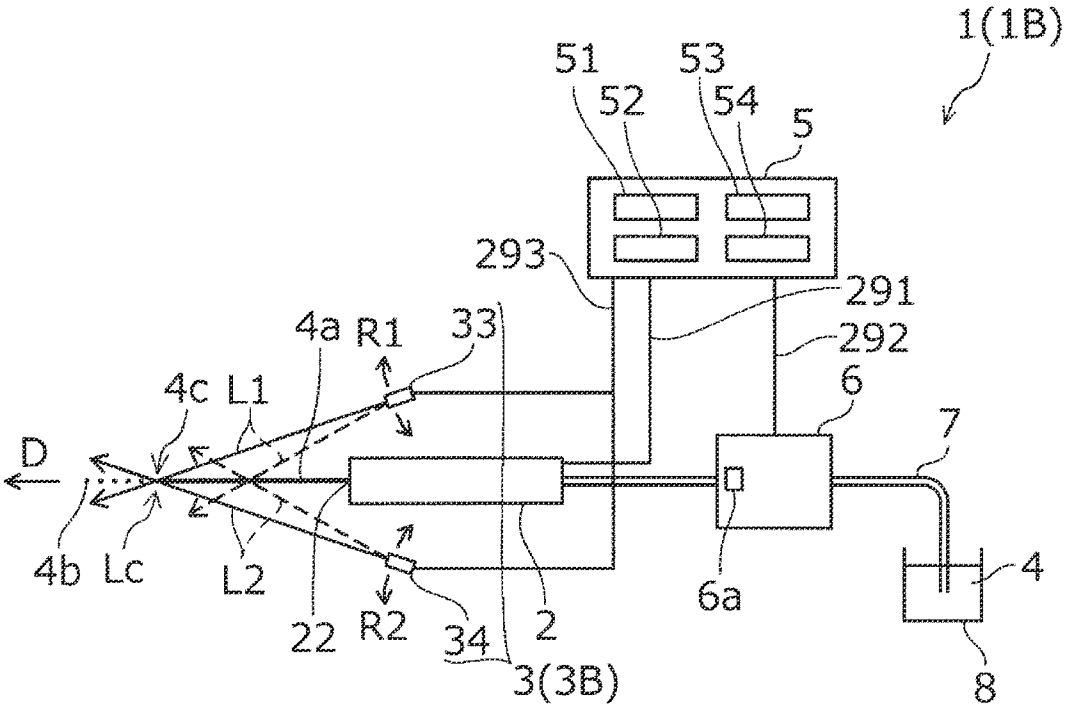
FIG. 10 is a schematic diagram showing a liquid ejection device according to a second embodiment.

Next, a liquid ejection device 1B according to a second embodiment as the liquid ejection device 1 according to the present disclosure will be described with reference to FIG. 10. FIG. 10 is a diagram corresponding to FIGS. 1 and 2 showing the liquid ejection device 1 according to the first embodiment, and components common to those of the first embodiment are denoted by the same reference signs in FIG. 10, and a detailed description thereof is omitted. Here, the liquid ejection device 1B according to the present embodiment has characteristics similar to those of the liquid ejection device 1A according to the first embodiment described above, and has the same configuration as that of the liquid ejection device 1A according to the first embodiment except the points described below. Specifically, a configuration of the liquid ejection device 1B is the same as that of the liquid ejection device 1A according to the first embodiment except a configuration of the light source unit 3.

As shown in FIGS. 1 and 2, the light source unit 3A in the liquid ejection device 1A according to the first embodiment has a configuration in which the intersection position Lc with respect to the droplet formation position 4*c* can be changed by moving the entire light source unit 3A with respect to the ejecting unit 2 in the movement direction M along the ejection direction D. On the other hand, as shown in FIG. 10, a light source unit 3B in the liquid ejection device 1B according to the present embodiment includes a first light irradiation unit 33 capable of swinging in a swing direction R1 and a second light irradiation unit 34 capable of swinging in a swing direction R2, and changes an angle at which the first light irradiation unit 33 and the second light irradiation unit 34 are disposed under the control of the control unit 5, so as to change the intersection position Lc with respect to the droplet formation position 4*c*.

Third Embodiment

Figure 11:
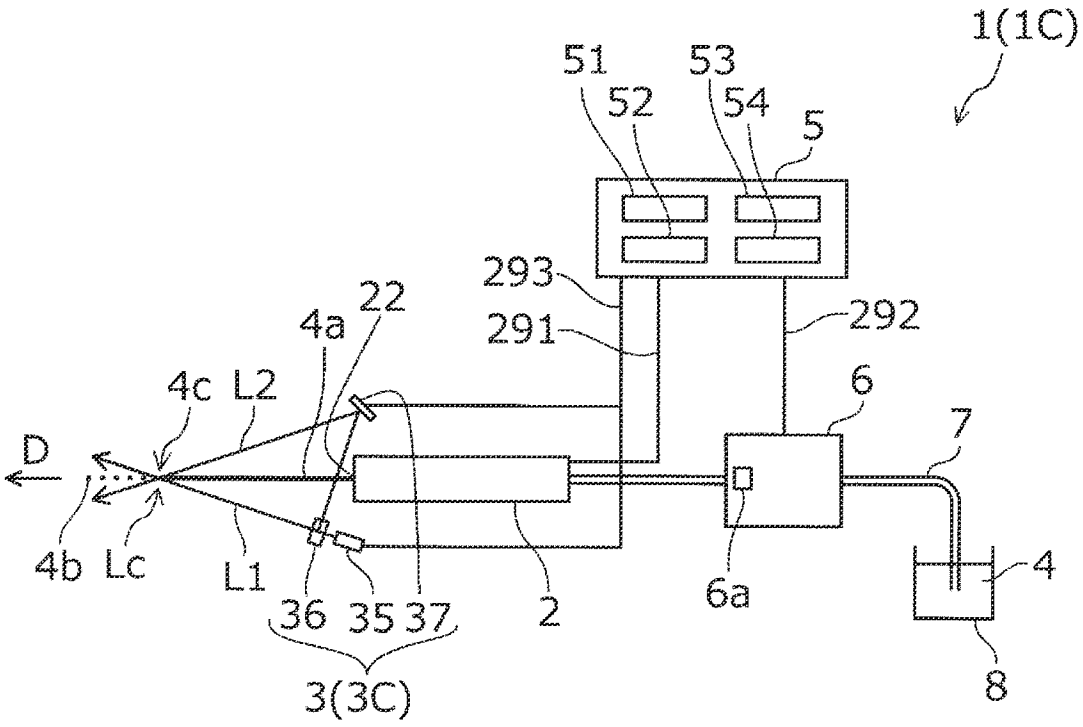
FIG. 11 is a schematic diagram showing a liquid ejection device according to a third embodiment.

Next, a liquid ejection device 1C according to a third embodiment as the liquid ejection device 1 according to the present disclosure will be described with reference to FIG. 11. FIG. 11 is a diagram corresponding to FIGS. 1 and 2 showing the liquid ejection device 1 according to the first embodiment, and components common to those of the first embodiment and the second embodiment are denoted by the same reference signs in FIG. 11, and a detailed description thereof is omitted. Here, the liquid ejection device 1C according to the present embodiment has characteristics similar to those of the liquid ejection device 1A according to the first embodiment and the liquid ejection device 1B according to the second embodiment described above, and has the same configuration as that of the liquid ejection device 1A according to the first embodiment and that of the liquid ejection device 1B according to the second embodiment except the points described below. Specifically, a configuration of the liquid ejection device 1C is the same as that of the liquid ejection device 1A according to the first embodiment and that of the liquid ejection device 1B according to the second embodiment except the configuration of the light source unit 3.

As described above, the light source unit 3A in the liquid ejection device 1A according to the first embodiment and the light source unit 3B in the liquid ejection device 1B according to the second embodiment include two light irradiation units. On the other hand, as shown in FIG. 11, a light source unit 3C in the liquid ejection device 1C according to the present embodiment includes one light irradiation unit 35, a light splitter 36 that makes incident light emit in two directions, and a mirror 37 that reflects light in one direction of the light separated by the light splitter 36. Further, the intersection position Lc with respect to the droplet formation position 4*c* can be changed by changing, under the control of the control unit 5, an angle at which the light irradiation unit 35, the light splitter 36, and the mirror 37 are arranged.

The present disclosure is not limited to the embodiments described above, and can be implemented in various configurations without departing from the scope of the disclosure. In order to solve some or all of problems described above, or to achieve some or all of effects described above, technical characteristics in the embodiments corresponding to the technical characteristics in each embodiment described in the summary of the disclosure can be replaced or combined as appropriate. The technical characteristics can be deleted as appropriate unless the technical characteristics are described as essential in the present description.

What is claimed is:

1. A liquid ejection device, comprising:

an ejecting unit configured to eject a liquid from a nozzle in a first direction, wherein the ejecting unit has a configuration in which the liquid is continuously ejected from the nozzle, and the liquid in a continuous state is formed into a droplet at a droplet formation position on an extension line in the first direction from the nozzle; and a light source unit comprising:

a first light irradiation unit configured to emit light in a first optical path, and a second light irradiation unit configured to emit light in a second optical path, wherein the first light irradiation unit and the second light irradiation unit are arranged such that the first optical path and the second optical path intersect on the extension line, and the light source unit has a configuration in which both the first light irradiation unit and the second light irradiation unit are fixed to an arm unit at a predetermined angle, and are movable in a movement direction that is a direction along the first direction in which the liquid is ejected by the ejecting unit.

2. The liquid ejection device according to claim 1, wherein the light source unit is configured to adjust an intersection position of the first optical path and the second optical path on the extension line.

3. The liquid ejection device according to claim 2, wherein the light in the first optical path and the light in the second optical path is both visible light and has different wavelengths.

4. The liquid ejection device according to claim 1, wherein an intersection position of the first optical path and the second optical path on the extension line is the droplet formation position.

5. The liquid ejection device according to claim 4, further comprising:

a processor configured to control an ejection state of the liquid ejected by the ejecting unit and adjust the intersection position by the light source unit, wherein the processor adjusts the intersection position according to the ejection state.

6. The liquid ejection device according to claim 5, further comprising:

a pump configured to change a flow rate of the liquid in the nozzle;

a flowmeter configured to measure the flow rate; and a memory configured to store data related to the intersection position based on the flow rate, wherein the processor adjusts the intersection position based on a flow rate measurement result of the flowmeter and the data stored in the memory.

7. The liquid ejection device according to claim 6, wherein the light in the first optical path and the light in the second optical path is both visible light and has different wavelengths.

8. The liquid ejection device according to claim 4, wherein the light in the first optical path and the light in the second optical path is both visible light and has different wavelengths.

9. The liquid ejection device according to claim 5, wherein the light in the first optical path and the light in the second optical path is both visible light and has different wavelengths.

10. The liquid ejection device according to claim 1, wherein the light in the first optical path and the light in the second optical path is both visible light and has different wavelengths.

* * * * *